US006231041B1

(12) United States Patent
Jacques

(10) Patent No.: US 6,231,041 B1
(45) Date of Patent: May 15, 2001

(54) METHOD AND APPARATUS FOR SEPARATING 2-UP SHEETS

(75) Inventor: Roger A. Jacques, Rochester, NH (US)

(73) Assignee: Moore U.S.A. Inc., Grand Island, NY (US)

( * ) Notice: Subject to any disclaimer, the term of this patent is extended or adjusted under 35 U.S.C. 154(b) by 0 days.

(21) Appl. No.: 09/237,094

(22) Filed: Jan. 25, 1999

(51) Int. Cl.[7] ..... B65H 3/52
(52) U.S. Cl. ..... 271/121; 271/182
(58) Field of Search ..... 271/109, 121, 271/270, 182, 264, 272

(56) References Cited

U.S. PATENT DOCUMENTS

| | | |
|---|---|---|
| 4,696,464 | 9/1987 | Gammerler . |
| 5,575,466 | 11/1996 | Tranquilla . |
| 5,582,399 | 12/1996 | Sugiura . |

FOREIGN PATENT DOCUMENTS

| | | | |
|---|---|---|---|
| 61-273445 * | 12/1986 | (JP) | 271/272 |
| 1-117143 * | 5/1989 | (JP) | 271/121 |

* cited by examiner

*Primary Examiner*—David H. Bollinger
(74) *Attorney, Agent, or Firm*—Simpson Simpson & Snyder, LLP

(57) ABSTRACT

An apparatus for separating an upper sheet from a lower sheet comprising a first roller having an axis of rotation and a sheet engaging surface arranged to frictionally engage the upper sheet, a second roller having an axis of rotation arranged in spaced relation to the axis of rotation of the first roller, the second roller having a sheet engaging surface arranged to frictionally engage the lower sheet, and, drive means for rotating the first and second rollers about their respective axes of rotation to produce different surface speeds at the sheet engaging surfaces of the first and second rollers, whereby the upper and lower sheets are separated into a non-coincident configuration by respective frictional engagement with the first and second rollers. The invention also comprises a method for separating the aforementioned upper and lower sheets.

23 Claims, 4 Drawing Sheets

FIG. 2
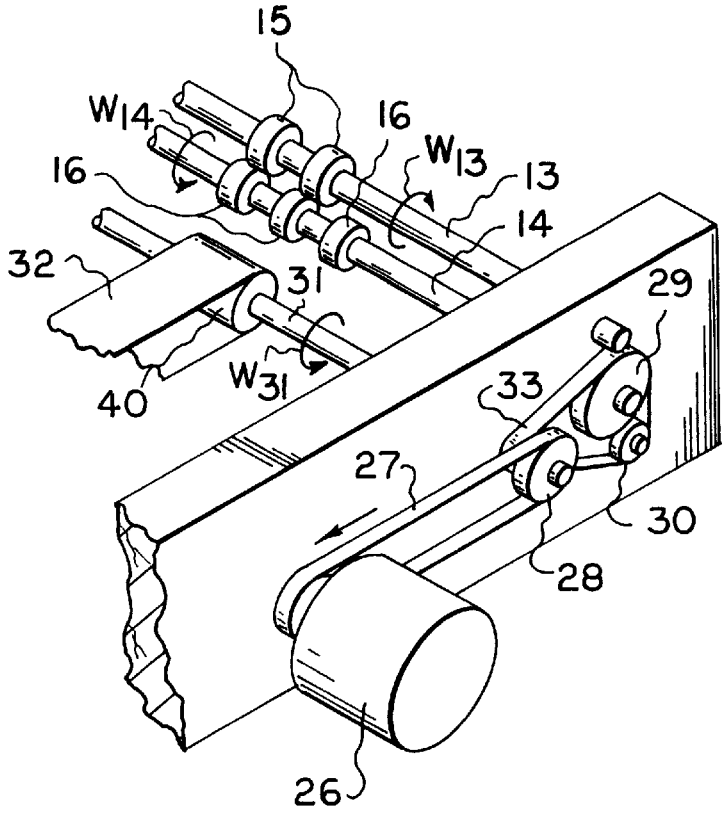
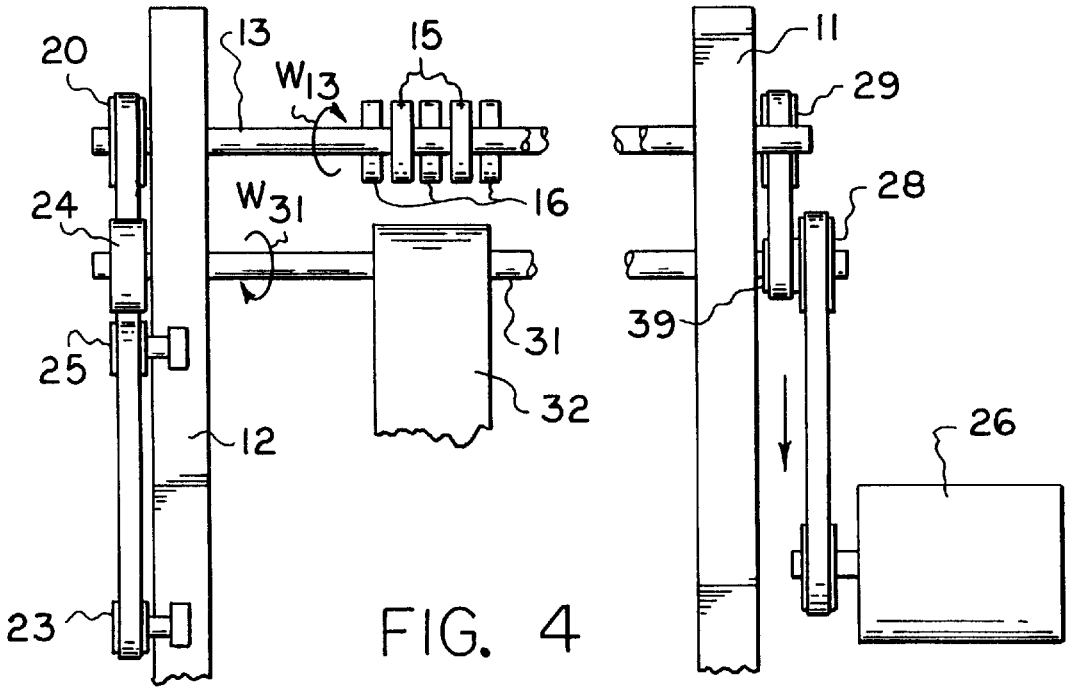
FIG. 4

METHOD AND APPARATUS FOR SEPARATING 2-UP SHEETS

FIELD OF THE INVENTION

This invention relates generally to business forms and, more particularly, to a method and apparatus for separating sheets that are arranged one atop the other.

BACKGROUND OF THE INVENTION

Job sorting the 2-wide output from a continuous web printer after cutting (or bursting) requires the sheets to be separated to eliminate the need for blank pages. The sheets in need of separation comprise an upper and lower sheet, overlapping and usually, but not always, coincident with one another. Usually, but not necessarily, the sheets are of identical dimensions. "Separation" of the sheets means to separate the overlapping sheets and arrange the separate sheets end to end, beside or adjacent one another, although separation can also mean disturbing the coincidence of the sheets and causing them to overlap instead.

Surprisingly, the prior art is void of an acknowledgment of the problem solved by the present invention, much less a solution. In U.S. Pat. No. 4,696,464 (Gämmerler), for example, a method and apparatus is disclosed for uniting at least two streams of shingled laid out products (particularly folded products), almost exactly the opposite of the present invention.

Similarly, U.S. Pat. No. 5,575,466 (Tranquilla) discloses a means of adjusting the gap size between sheets fed by a sheet feeder. But this invention is used to adjust the gap between sheets that have already been separated, as opposed to a device that separates overlapping, coincident sheets.

Thus, there is a need for a method and apparatus for separating overlapping, coincident sheets.

SUMMARY OF THE INVENTION

The invention broadly comprises an apparatus for separating an upper sheet arranged overlapping and substantially coincident with a lower sheet. The apparatus includes a first roller having an axis of rotation and a sheet engaging surface arranged to frictionally engage the upper sheet, a second roller having an axis of rotation arranged in spaced relation to the axis of rotation of the first roller, the second roller having a sheet engaging surface arranged to frictionally engage the lower sheet, and, drive means for rotating the first and second rollers about their respective axes of rotation to produce different surface speeds at the sheet engaging surfaces of the first and second rollers, whereby the upper and lower sheets are separated into a non-coincident configuration by respective frictional engagement with the first and second rollers. The invention also comprises a method for separating the aforementioned upper and lower sheets.

A general object of the invention is to provide a method and apparatus for separating sheets arranged in overlapping and coincident orientation with respect to one another.

Another object of the invention is to provide a method and apparatus for the aforementioned separation to be implemented as a part of a web process, i.e., as the sheets travel along a conveyor.

These and other objects, features and advantages of the invention will become readily apparent to those having ordinary skill in the art upon a reading of the following detailed description in view of the drawings and appended claims.

BRIEF DESCRIPTION OF THE DRAWINGS

FIG. 2 is a fragmentary perspective view of the preferred embodiment of the apparatus shown in FIG. 1, taken from a second side of the apparatus;

FIG. 4 is a fragmentary plan view of the apparatus of the invention;

DETAILED DESCRIPTION OF THE PREFERRED EMBODIMENT

Figure 1:
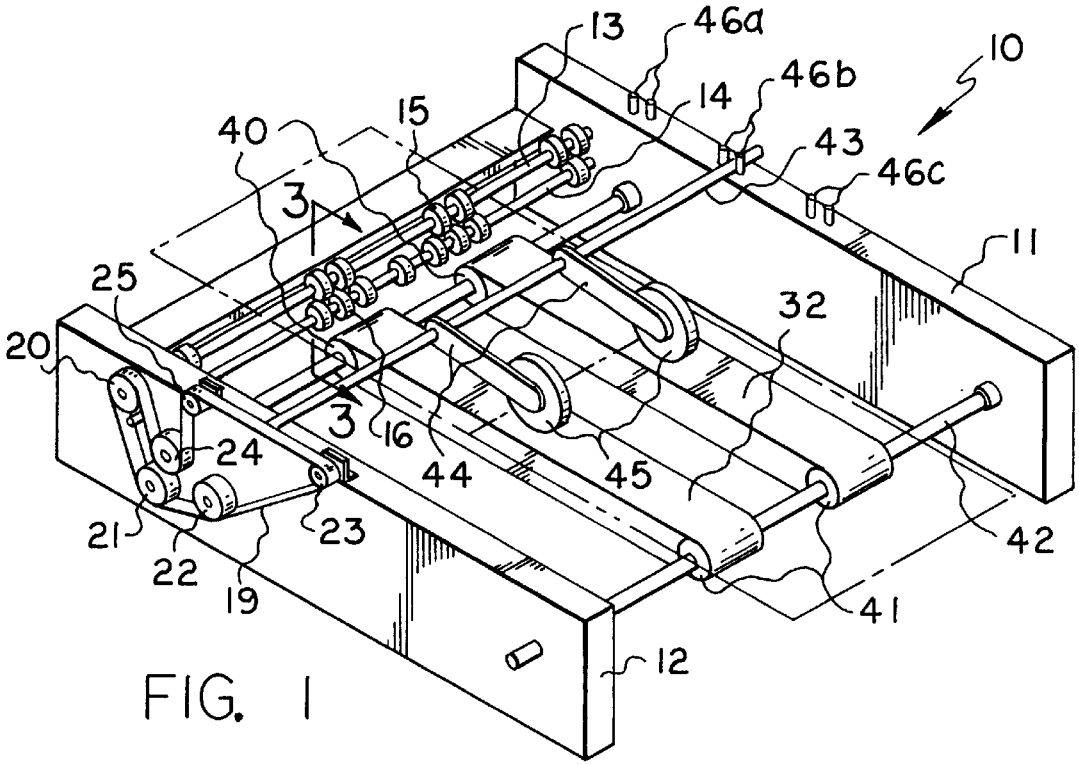
FIG. 1 is a perspective view of a preferred embodiment of the apparatus of the invention, taken from a first side of the apparatus.

At the outset, it should be understood that, although a preferred embodiment of the apparatus of the invention is illustrated in the drawings, the invention as claimed is not intended to be limited to the precise embodiment shown. The invention is generally directed to a method and apparatus for separating an upper and lower sheet from one another by use of opposing rollers that engage the upper and lower sheets at different surface speeds. In one embodiment, the upper and lower sheets are arranged in overlapping and coincident configuration, although this is not a requirement of the invention. Also, the in embodiment shown, the upper and lower (first and second) rollers are of equal diameter, but this also is not required. It should also be understood that the claims of the invention are not directed or limited to any particular drive means for the rollers. Obviously, the rollers could be driven by pulleys, gears, directly by motors, or by a variety of other means. The rollers could be coupled together by a common drive with speed control achieved by pulleys, gears or the like, or the rollers can be driven and controlled separately. In an embodiment shown the top roller is oversped with respect to the lower roller, but the invention works equally well with the lower roller oversped with respect to the upper roller. Finally, the apparatus is designed to accommodate sheets made of paper, but could separate sheets made of other materials of various shapes and sizes.

Adverting now to FIG. 1, sheet separating apparatus 10 is shown in perspective to include frame members 11 and 12, arranged in parallel spaced relation to one another. Upper rotatable shaft 13 and lower rotatable shaft 14 are arranged transversely to frame members 11 and 12 and rotatably secured thereto. Both shafts are arranged for rotation. Fixedly secured to upper rotatable shaft 13 are first rollers 15. Fixedly secured to lower shaft 14 are second rollers 16. As best shown in FIG. 2, in a preferred embodiment, shaft 13 is arranged in parallel spaced relation to shaft 14. Also in a preferred embodiment, rollers 15 are each of identical diameter, and rollers 16 are each of identical diameter. It is not necessary that rollers 15 and 16 be of identical diameter, but, in a preferred embodiment, the rollers are arranged for rotation such that the surface speed of roller 15 at the point of contact with the upper sheet is higher than the surface speed of roller 16 at the point of contact with the lower sheet.

Figure 3:
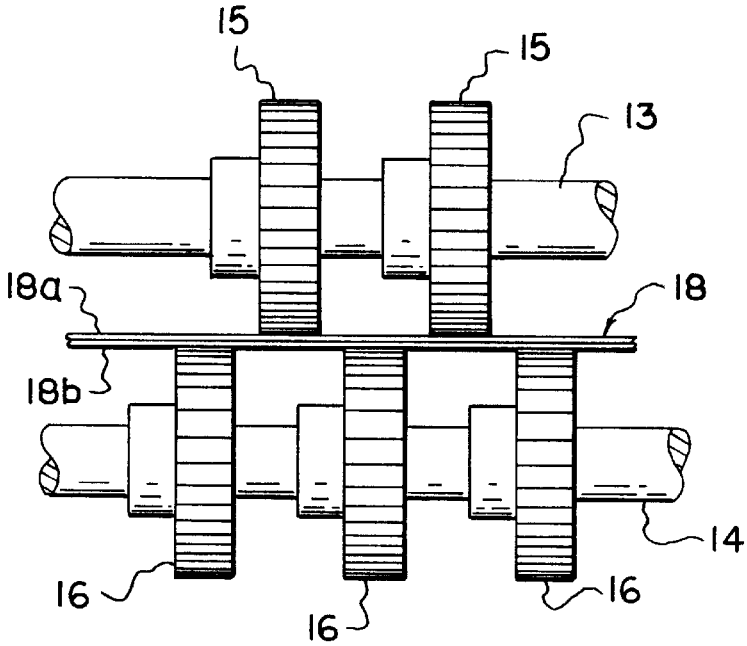
FIG. 3 is a fragmentary end view of the invention taken generally along line 3—3 in FIG. 1.

As shown in FIG. 3, the shafts and rollers are arranged to produce a small gap between rollers 15 and 16, such that each of the rollers frictionally engage a combination upper/lower sheet 18 to be separated. Combination upper/lower sheet 18 comprises an upper sheet 18*a* and a lower sheet 18*b*. The rollers may be made of any suitable material, but preferably are made of a material such as plastic or rubber to cause sufficient friction to engage the sheets. The number of rollers, size, shape, spacing, coating, and horizontal and vertical locations of the rollers are selected to provide greater frictional coupling to the sheet than the coupling force between sheets. Some minor experimentation may be required in initial set-up of the apparatus. Although the embodiment shown in FIG. 1 includes four first rollers and seven second rollers, it should be appreciated that the exact number of rollers is not critical to the invention.

Also as shown in FIG. 3, in a preferred embodiment, rollers 15 and 16 are staggered with respect to one another. Viewing FIG. 3 from left to right, second roller 16 engages lower sheet 18*b*, then first roller 15 engages upper sheet 18*a*, then second roller 16 engages lower sheet 18*b*, etc. This staggered orientation of the rollers is preferred but not necessary.

The rollers may be driven in any number of ways known in the art. For example, separate motors can directly drive each shaft to which the rollers are mounted. Alternatively, the shafts can be driven by one or two motors through a gearbox. Finally, and as shown in FIGS. 1 and 2, the shafts can be motor driven (by a single motor) with speed differentiation achieved through sheaves of different diameters driven by pulleys. For example, as shown in FIG. 2, motor 26 drives sheave 28 through pulley 27 which, in turn, drives sheaves 29 and 30 through pulley 33. Sheave 29 is fixedly secured to shaft 14, to which are mounted rollers 16. Sheave 28 is fixedly secured to shaft 31 which drives conveyor belt 32 through roller 40.

Adverting now to FIG. 1, it is seen that shaft 31 also directly drives sheave 24 which is fixedly secured to shaft 31. Adverting now to FIG. 1, it is seen that sheave 24 is fixedly secured to shaft 31 and therefore rotates therewith. As sheave 24 rotates it drives serpentine pulley 19 about sheaves 20, 21, 22, 23 and 24. Obviously, by varying the diameter of the sheaves associated with the driven shafts, the speed of rotation of the shafts can also be varied. For example, to achieve a surface speed of roller 15 at a point of engagement with the upper sheet which is twice as fast as the surface speed of roller 16 at a point of engagement with the lower sheet, the diameter of sheave 29 must be twice as large as the diameter of sheave 20 (assuming rollers 15 and 16 are of equal diameter).

Operation

Figure 5:
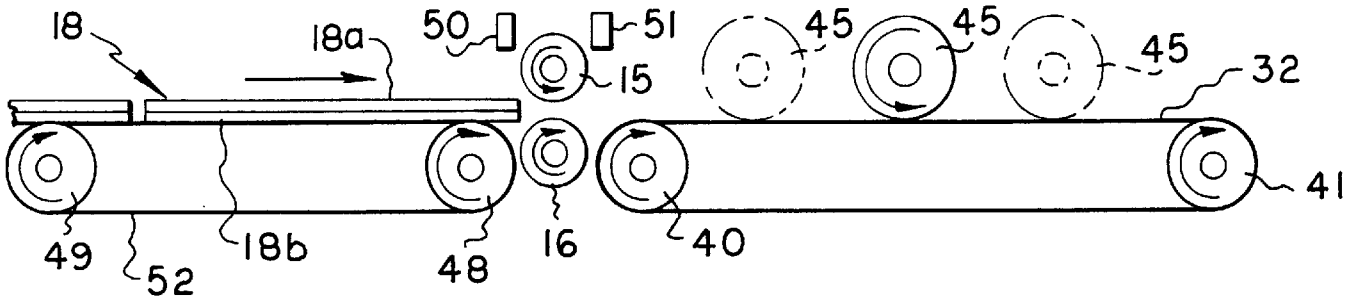
FIG. 5 is a fragmentary elevation illustrating an upper sheet arranged overlapping and substantially coincident with a lower sheet being feed into the apparatus of the invention.
Figure 6:
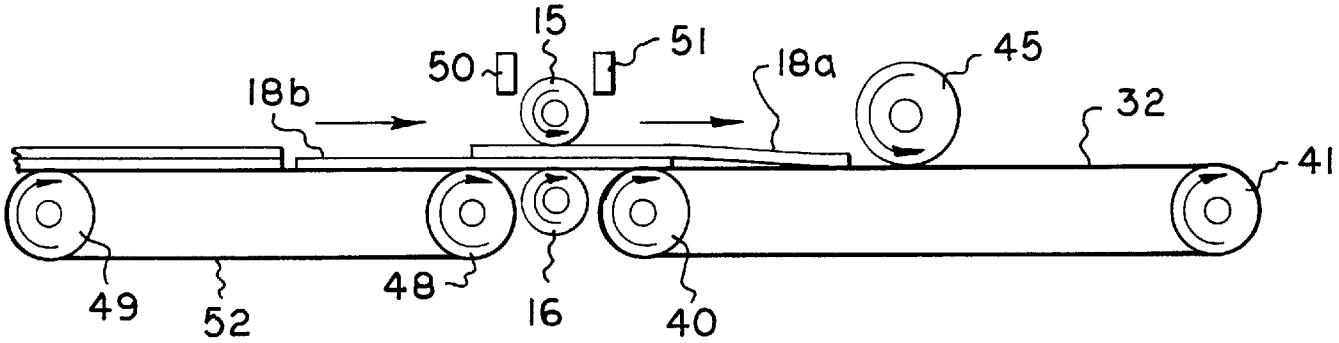
FIG. 6 is a view similar to that of FIG. 5, except with the upper and lower sheet being acted upon by the first and second rollers.

As shown in FIG. 5, overlapping sheets 18 enter the apparatus via a feed means which comprises a conveyor having rollers 48 and 49 and conveyor belt 52. The feed conveyor can be driven separately, or by the same drive means that drives the separation rollers 15 and 16. As shown in FIG. 5, sheets 18 are directed towards first roller 15 and second roller 16. Adverting both to FIGS. 3 and 6, sheets 18 are shown positioned between the rollers, with upper sheet 18*a* in contact with first roller 15, and lower sheet 18*b* in contact with second roller 16. The surface speed of roller 15 at the point of contact with upper sheet 18*a* is adjusted to be greater than the surface speed of roller 16 at the point of contact with lower sheet 18*b*. In a preferred embodiment, a ratio of surface speed of at least 2:1 between the first and second rollers was found ideal for separation, although other ratios will also be suitable. The speed differential causes the upper sheet to progress ahead of the lower sheet as shown in FIG. 6. It should be appreciated that, in a preferred embodiment, the slower roller is arranged to rotate with an associated surface speed which is slightly faster than the conveyor belt speed of the feed means. Also, the overspeed differential between the rollers occurs only during the time at which the two sheets being separated are located in the gap between the rollers. Electronic sensors, discussed infra, are used to monitor the position of the sheets, and encoders are used to monitor roller speed.

Figure 7:
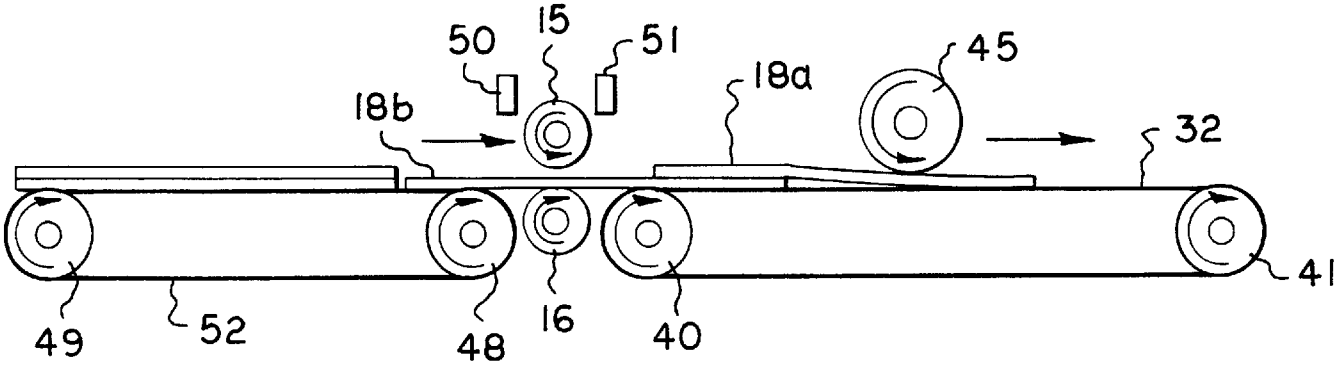
FIG. 7 is a view similar to that of FIG. 6 where the upper sheet has been passed to the exit means; the lower sheet is still being acted upon by the first and second roller; and the upper and lower sheet are now overlapping by not coincident.

In FIG. 7, the upper sheet has progressed enough to be acted upon by roller 45, which, as shown in FIG. 1, is pivotally connected to non-rotational shaft 43 by pivot arm 44. Roller 45 functions to keep the sheets in position on the exit means, which comprises a conveyor of rollers 40 and 41, and conveyor belt 32. Also as shown in FIG. 1, and schematically in FIG. 5 by the phantom views of roller 45, shaft 43 is held in place by pegs 46*a*, 46*b* or 46*c*, mounted on member 11 (and similar means on member 12 not shown) to accommodate sheets of various sizes. Roller 45 is free-wheeling, and not driven. As sheet 18*a* is propelled ahead of sheet 18*b*, sheet 18*b* is now acted upon by roller 16 alone as shown in FIG. 7.

Figure 8:
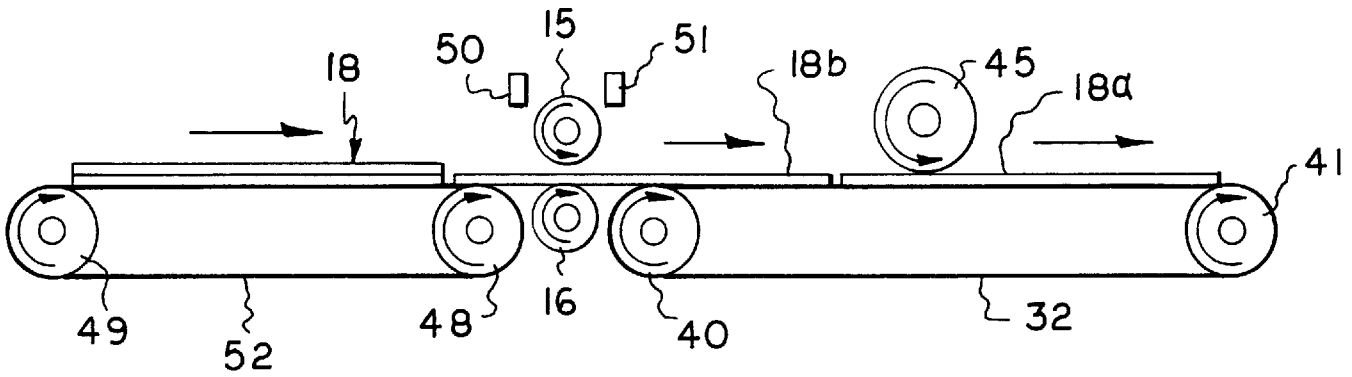
FIG. 8 is a view similar to that of FIG. 7 where the upper sheet has been passed to the exit means; the lower sheet is still being acted upon by the first and second rollers; and the upper and lower sheet are no longer overlapping or coincident.

Adverting to FIG. 8, sheet 18*a* is shown propelled ahead of sheet 18*b*. Thus, the apparatus has now arranged the sheets in non-overlapping and non-coincident orientation. It should be appreciated that the apparatus could be operated (by adjusting the roller surface speeds) to arrange the sheets on the exit conveyor in overlapping (but non-coincident) orientation. As shown in FIGS. 7 and 8, once leading sheet 18*a* has cleared the rollers and advanced toward the exit means, trailing sheet 18*b* is now operated upon only by second roller 16, and not by roller 15. Thus, the gap between the rollers is critical, and should, in a preferred embodiment, be adjustable to accommodate sheets of varying thicknesses and frictional coefficients. Means for adjusting gap widths between the rollers are well known to those having ordinary skill in the art.

Figure 9:
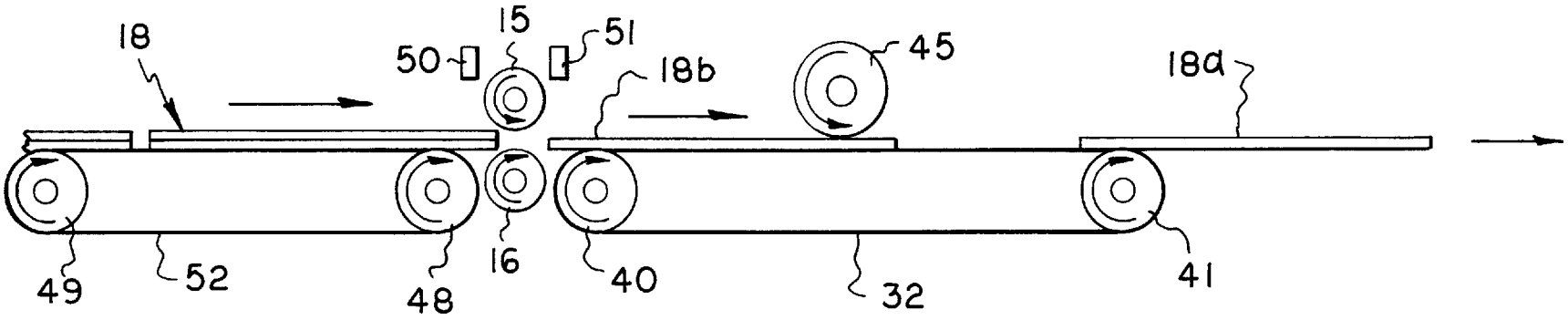
FIG. 9 is a view similar to that of FIG. 8 where both the upper and lower sheets have been passed to the exit means and a gap exists between the upper and lower sheets.

Finally, as shown in FIG. 9 both upper sheet 18*a* and lower sheet 18*b* have cleared the rollers and are arranged in non-overlapping and non-coincident orientation on the exit conveyor 32, and the next sheet 18 is poised to enter the roller combination.

Thus, it is seen that the apparatus comprises a first roller having an axis of rotation. The first roller has a sheet engaging surface (located about the circumference of the roller) which is arranged to frictionally engage the upper sheet. The apparatus also includes a second roller having an axis of rotation arranged in spaced relation to the axis of rotation of the first roller. In a preferred embodiment, the respective axes of rotation are parallel to one another. The second roller also has a sheet engaging surface (located abut the circumference of the roller) which is arranged to frictionally engage the lower sheet. The apparatus is also shown to include drive means for rotating the first and second rollers about their respective axes of rotation to produce different surface speeds at the sheet engaging surfaces of the first and second rollers, whereby the upper and lower sheets are separated by respective frictional engagement with the first and second rollers.

The apparatus also contains sensors 50 and 51, shown in FIGS. 5–9, which are arranged to detect the location and speed of the respective sheets as they progress through the apparatus. The sensors can be arranged to detect the leading or trailing edges of the sheets, and can be integrated with control circuits, or a computer, to control the speed of the respective rollers and feed and exit conveyors to vary the gaps between the sheets as they exit the machine, or to vary the degree to which the sheets overlap upon exit. An encoder, not shown, but well known in the art, can be coupled to each roller to monitor its speed and sheet flow. In a preferred embodiment, sensor 50 is arranged to detect the leading edge of the 2-up set of sheets to initiate the separation process. Then either the top or bottom rollers are oversped relative to the other by a factor of 2× for the time that the oversped sheet is in the nip of the rollers. The second sensor 51 detects the leading edge of the lead sheet upon exit and the trailing edge of the trailing sheet. As described previously, in a preferred embodiment, one of the rollers is oversped with respect to the other only during the time the sheets are located in the gap between the rollers. At all other times, the rollers are arranged to rotate at the same speed.

The invention provides an efficient method of separating 2-up sheets. In a preferred embodiment, the method comprises passing coincident upper and lower sheets between a first roller having an axis of rotation and a sheet engaging surface arranged to frictionally engage the upper sheet and a second roller having an axis of rotation arranged in spaced relation to the axis of rotation of the first roller, the second roller having a sheet engaging surface arranged to frictionally engage the lower sheet, and, drive means for rotating the first and second rollers about their respective axes of rotation to produce different surface speeds at the sheet engaging surfaces of the first and second rollers, whereby the upper and lower sheets are separated into a non-coincident configuration by respective frictional engagement with the first and second rollers. Of course, it is not necessary that the upper and lower sheets be coincident with one another prior to separation—they might just be overlapping.

Thus, it is seen that the objects of the invention are efficiently obtained, although modifications and changes may be made to the invention by those having ordinary skill in the art without departing from the spirit and scope of the invention.

What I claim is:

1. An apparatus for separating an upper sheet from a lower sheet, said apparatus comprising:

a first roller having an axis of rotation and a sheet engaging surface arranged to frictionally engage said upper sheet, said first roller operatively arranged for rotation in a first rotational direction;

a second roller having an axis of rotation arranged in spaced relation to said axis of rotation of said first roller, said second roller having a sheet engaging surface arranged to frictionally engage said lower sheet, said second roller operatively arranged for rotation in a second rotational direction, where said first rotational direction is opposite said second rotational direction; and, drive means for rotating said first and second rollers about their respective axes of rotation to produce different surface speeds at said sheet engaging surfaces of said first and second rollers;

whereby said upper and lower sheets are separated by respective frictional engagement with said first and second rollers.

2. An apparatus as recited in claim 1, further comprising feed means for introducing said upper and lower sheets in overlapping and substantially coincident relationship for respective frictional engagement by said sheet engaging surface of said first roller and said sheet engaging surface of said second roller.

3. An apparatus as recited in claim 2, wherein said different surface speeds at said sheet engaging surfaces are sufficient to separate said upper and lower sheets into a non-overlapping configuration.

4. An apparatus as recited in claim 2, wherein said different surface speeds at said sheet engaging surfaces are sufficient to separate said upper and lower sheets into a non-coincident configuration.

5. An apparatus as recited in claim 1, further comprising an exit means for ejecting said separated upper and lower sheets from said apparatus.

6. A method of separating an upper sheet arranged overlapping and substantially coincident with a lower sheet, said method comprising:

passing said upper and lower sheets between a first roller having an axis of rotation and a sheet engaging surface arranged to frictionally engage said upper sheet, said first roller rotating in a first rotational direction, and a second roller having an axis of rotation arranged in spaced relation to said axis of rotation of said first roller, said second roller having a sheet engaging surface arranged to frictionally engage said lower sheet, said second roller rotating in a second rotational direction, where said second rotational direction is opposite said first rotational direction; and, rotating said first and second rollers about their respective axes of rotation to produce different speeds of said sheet engaging surfaces of said first and second rollers;

separating said upper and lower sheets into a non-coincident configuration by respective frictional engagement with said first and second rollers.

7. A method as recited in claim 6 wherein said first roller rotates to produce a surface speed at said sheet engaging surface which is faster than said surface speed of said second roller sheet engaging surface.

8. A method as recited in claim 7 wherein said first roller rotates to produce a surface speed of said sheet engaging surface which is at least twice as fast as said surface speed at said second roller sheet engaging surface.

9. An apparatus for separating an upper sheet from a lower sheet, said apparatus comprising:

a first roller having an axis of rotation and a sheet engaging surface arranged to frictionally engage said upper sheet;

a second roller having an axis of rotation arranged in spaced relation to said axis of rotation of said first roller, said second roller rotating in the opposite sense with respect to the first roller, said second roller having a sheet engaging surface arranged to frictionally engage said lower sheet;

wherein said first and second rollers are equal in diameter; and, drive means for rotating said first and second rollers about their respective axes of rotation to produce different surface speeds at said sheet engaging surfaces of said first and second rollers;

whereby said upper and lower sheets are separated by respective frictional engagement with said first and second rollers.

10. An apparatus as recited in claim 9, further comprising feed means for introducing said upper and lower sheets in overlapping and substantially coincident relationship for respective frictional engagement by said sheet engaging surface of said first roller and said sheet engaging surface of said second roller.

11. An apparatus as recited in claim 10 wherein said feed means is a conveyor.

12. An apparatus as recited in claim 9 further comprising an exit means for ejecting said separated upper and lower sheets from said apparatus.

13. An apparatus as recited in claim 12 wherein said exit means is a conveyer.

14. An apparatus for separating an upper sheet from a lower sheet, said apparatus comprising:

a first roller having an axis of rotation and a sheet engaging surface arranged to frictionally engage said upper sheet;

a second roller having an axis of rotation arranged in spaced relation to said axis of rotation of said first roller, said second roller rotating in the opposite sense with respect to the first roller, said second roller having a sheet engaging surface arranged to frictionally engage said lower sheet;

drive means for rotating said first and second rollers about their respective axes of rotation to produce different directions of rotations; and, wherein said drive means is operatively arranged to produce a higher surface speed at said sheet engaging surface of said first roller than at said sheet engaging surface of said second roller;

whereby said upper and lower sheets are separated by respective frictional engagement with said first and second rollers.

15. An apparatus as recited in claim 14, further comprising feed means for introducing said upper and lower sheets in overlapping and substantially coincident relationship for respective frictional engagement by said sheet engaging surface of said first roller and said sheet engaging surface of said second roller.

16. An apparatus as recited in claim 15 wherein said feed means is a conveyor.

17. An apparatus as recited in claim 14, further comprising an exit means for ejecting said separated upper and lower sheets from said apparatus.

18. An apparatus as recited in claim 17 wherein said exit means is a conveyer.

19. An apparatus for separating an upper sheet from a lower sheet, said apparatus comprising:

a first roller having an axis of rotation and a sheet engaging surface arranged to frictionally engage said upper sheet;

a second roller having an axis of rotation arranged in spaced relation to said axis of rotation of said first roller, said second roller rotating in the opposite sense with respect to the first roller, said second roller having a sheet engaging surface arranged to frictionally engage said lower sheet; and, drive means for rotating said first and second rollers about their respective axes of rotation to produce different directions of rotations;

wherein said drive means is operatively arranged to produce a surface speed at said sheet engaging surface of said first roller which is at least twice as fast as the surface speed at said sheet engaging surface of said second roller;

whereby said upper and lower sheets are separated by respective frictional engagement with said first and second rollers.

20. An apparatus as recited in claim 19, further comprising feed means for introducing said upper and lower sheets in overlapping and substantially coincident relationship for respective frictional engagement by said sheet engaging surface of said first roller and said sheet engaging surface of said second roller.

21. An apparatus as recited in claim 20 wherein said feed means is a conveyor.

22. An apparatus as recited in claim 19, further comprising an exit means for ejecting said separated upper and lower sheets from said apparatus.

23. An apparatus as recited in claim 22 wherein said exit means is a conveyer.

* * * * *